US008136326B2

(12) United States Patent
Yan

(10) Patent No.: US 8,136,326 B2
(45) Date of Patent: Mar. 20, 2012

(54) STRUCTURE FOR STEEL DOOR

(76) Inventor: Xiaojun Yan, Guangzhou (CN)

( * ) Notice: Subject to any disclaimer, the term of this patent is extended or adjusted under 35 U.S.C. 154(b) by 725 days.

(21) Appl. No.: 12/207,492

(22) Filed: Sep. 9, 2008

(65) Prior Publication Data

US 2010/0043340 A1 Feb. 25, 2010

(30) Foreign Application Priority Data

Aug. 19, 2008 (CN) ..... 2008 1 0030267

(51) Int. Cl.
*E04C 2/38* (2006.01)
*E04F 13/00* (2006.01)

(52) U.S. Cl. ..... 52/656.6; 52/656.4; 52/656.2; 52/656.1; 52/311.1

(58) Field of Classification Search ..... 52/311.1, 52/311.2, 656.4, 656.2, 656.1, 656.6
See application file for complete search history.

(56) References Cited

U.S. PATENT DOCUMENTS 1,100,564 A * 6/1914 Heryford ..... 160/97
1,859,974 A * 5/1932 Kroenke ..... 160/97
3,895,669 A * 7/1975 Heeling ..... 160/92
4,270,333 A * 6/1981 Singer et al. ..... 52/656.8
4,912,877 A * 4/1990 Strydom ..... 49/171
5,072,488 A * 12/1991 Winyard ..... 16/241
5,365,706 A * 11/1994 Elsenpeter et al. ..... 52/204.1
6,526,694 B1 * 3/2003 Cosgrove ..... 49/67
7,121,004 B1 * 10/2006 Shoup ..... 29/897.312
7,661,227 B2 * 2/2010 Dudley et al. ..... 49/501
2010/0064625 A1 * 3/2010 Charlton et al. ..... 52/656.4
2010/0139187 A1 * 6/2010 Medina et al. ..... 52/204.1

* cited by examiner

*Primary Examiner* — Mark Wendell

(57) ABSTRACT

The present invention relates to an improved structure for a steel door which comprises a steel door frame and a steel door panel which is hinged on one side of the steel door frame, wherein the steel door panel comprises a steel-made door panel frame and a door opening defined by the door panel frame, the door opening has an interior portion which is disposed with a plurality of steel guarding members forming graphics, portions other than the guarding members in the door opening form hollowed units; a rear side of the door panel frame is disposed with a glass door panel which corresponds with the door opening, the glass door panel comprises a steel-made glass door panel frame which surrounds a peripheral body of the door opening and is formed on the rear side of the door panel frame, and a glass which is embedded in the glass door panel frame, one side of the glass door panel frame is hinged on one side of the door panel frame, the glass door panel frame is completely hidden behind the rear side of the door panel frame. The structure enables the entire content of the graphics formed by the plurality of members viewable from either the front side or the rear side of the steel door, thereby bringing about better visual effect on the graphical presentation and enhancing the artistic and ornamental quality of the steel door.

6 Claims, 9 Drawing Sheets

STRUCTURE FOR STEEL DOOR

BACKGROUND OF THE INVENTION

The present invention relates to an improved structure for a steel door and more particularly pertains to an improved structure for an indoor steel door.

There are many varieties of structures of indoor steel doors. Among which, the structure of a steel door comprises a steel door frame and a steel door panel (101) which is hinged on one side of the steel door frame. The steel door panel (101) comprises a steel-made door panel frame (102) and a door opening (103) defined by the door panel frame. The door opening (103) has an interior portion which is disposed with a plurality of members (104) forming graphics, portions other than the graphics in the door opening form hollowed units (105). The rear side of the door panel frame is disposed with a glass door panel (106) which corresponds with the door opening. The glass door panel (106) comprises a glass door panel frame (107) which surrounds a peripheral body of the door opening and is formed on the rear side of the door panel frame, and a glass (108) which is embedded in the glass door panel frame. One side of the glass door panel frame is hinged on one side of the door panel frame. A large portion of the glass door panel frame extends into the door opening (103), resulting in a large portion of the graphics formed by the plurality of the members (104) overlapping with the glass door panel frame as viewed from either the front side or the rear side. In other words, the glass door panel frame blocks out parts of the graphics, thereby seriously affecting the visual effect of the graphical presentation, and substantially diminishing the artistic and ornamental quality of the steel door. Besides, when the glass door is required to be opened for ventilation, the steel door in the prior art is not able to prevent mosquitoes, pests or other things from flying into a house from outside, thereby seriously affecting household living environment and body health.

BRIEF SUMMARY OF THE INVENTION

In view of the aforesaid disadvantages now present in the prior art, the object of the present invention is to provide an improved structure of a steel door of better artistic and ornamental quality.

Another object of the present invention is to provide an improved structure of a steel door which can prevent mosquitoes, pests or other things from flying into a house from outside after a glass door is opened for ventilation.

According to the improved structure provided by the present invention, it comprises a steel door frame and a steel door panel which is hinged on one side of the steel door frame; the steel door panel comprises a steel door panel frame and a door opening defined by the door panel frame; the door opening has an interior portion which is disposed with a plurality of steel guarding members forming graphics, portions other than the guarding members in the door opening form hollowed units; a rear side of the door panel frame is disposed with a glass door panel which corresponds with the door opening; the glass door panel comprises a steel-made glass door panel frame which surrounds a peripheral body of the door opening and is formed on the rear side of the door panel frame, and a glass which is embedded in the glass door panel frame; one side of the glass door panel frame is hinged on one side of the door panel frame; the glass door panel frame is completely hidden behind the rear side of the door panel frame.

Furthermore, the present invention has the following additional technical characteristics:

An anti-mosquito net which covers the door opening is disposed between a front side face of the glass door panel frame and a rear side face of the door panel frame corresponding thereto; a frame-shaped accommodating space is formed between a peripheral body of the front side face of the glass door frame and a peripheral body of the rear side face of the door panel frame; a periphery of the anti-mosquito net is secured in the accommodating space.

An anti-mosquito net frame for securing the anti-mosquito net is disposed in the accommodating space; the anti-mosquito net frame is completely hidden in the accommodating space; a peripheral body of a front side face of anti-mosquito net frame is secured with a magnetic strip which is capable of being attracted with the rear side face of the door panel frame corresponding thereto; the inner peripheral body of the anti-mosquito net frame forms a groove with an opening facing frontward or facing rearward; the periphery of the anti-mosquito net is placed in the groove, and is tightly pressed and secured by a rubber strip disposed in the groove.

A rearward protruding securing frame which surrounds the peripheral body of the door opening is disposed on the rear side of the door panel frame; the glass door panel frame comprises a hollow body of rectangular cross-sectional configuration disposed on an inner side of the securing frame; a first flat straight portion extends inwardly from a front end or a rear end of the body; a second flat straight portion extends outwardly from the rear end of the body; a pressing strip which corresponds to the first flat straight portion is secured on the body; a periphery of the glass is secured between the first flat straight portion and the pressing strip; a periphery of the second flat straight portion partially covers the rear side face of the securing frame; the second flat straight portion is disposed with hinges for being hinged on the securing frame.

A reinforcement panel is disposed at a hinged area between the second flat straight portion and the securing frame.

A rubber sealing strip is disposed between the hollow body and the securing frame.

A lower side of the steel door frame is further disposed with a threshold; a part of the door panel frame corresponding with the threshold is disposed with a drainage channel; one end of the drainage channel extends into the accommodating space, the other end slopes downwards and extends outward from a front lower side of the part of the door panel frame.

A rubber wiper which corresponds to a top face of the threshold is disposed on a bottom face of the part of the door panel frame; the front lower side of the part of the door panel frame is disposed with a curved water-proof cover.

According to the improved structure of a steel door provided by the present invention, the advantages in comparison with the prior art are as follows:

The glass door panel frame is completely hidden behind the rear side of the door panel frame. Such structure enables the entire content of the graphics formed by the plurality of members viewable from either the front side or the rear side of the steel door, thereby bringing better visual effect on the graphical presentation and enhancing the artistic and ornamental quality of the steel door. Besides, the anti-mosquito net is disposed between the front side face of the glass door panel frame and the rear side face of the door panel frame corresponding thereto to cover the door opening; after the glass door is opened for ventilation, it can prevent mosquitoes, pests or other things from flying into the house from outside, thereby guaranteeing ventilation inside the house, and also preventing mosquitoes and pests from getting into the house, and thus enhancing the utility of the steel door.

BRIEF DESCRIPTION OF THE DRAWINGS

The preferred embodiments of the present invention are further described in detail with the following embodiments and the accompanying drawings.

DETAILED DESCRIPTION OF THE INVENTION

Figure 1:
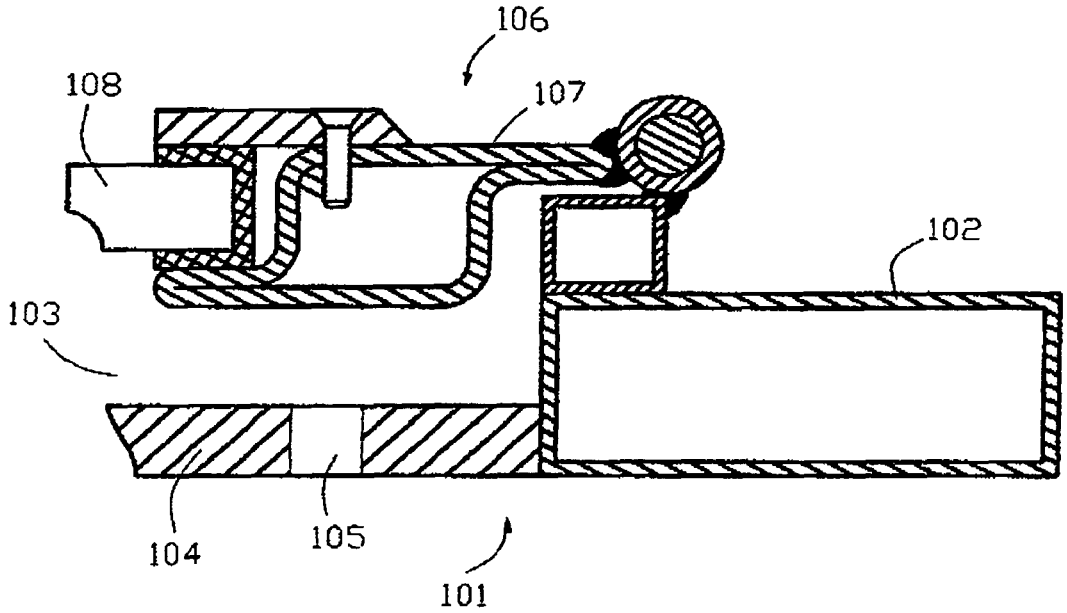
FIG. 1 PRIOR ART
FIG. 1 illustrates the structure of a steel door in the prior art.
Figure 2:
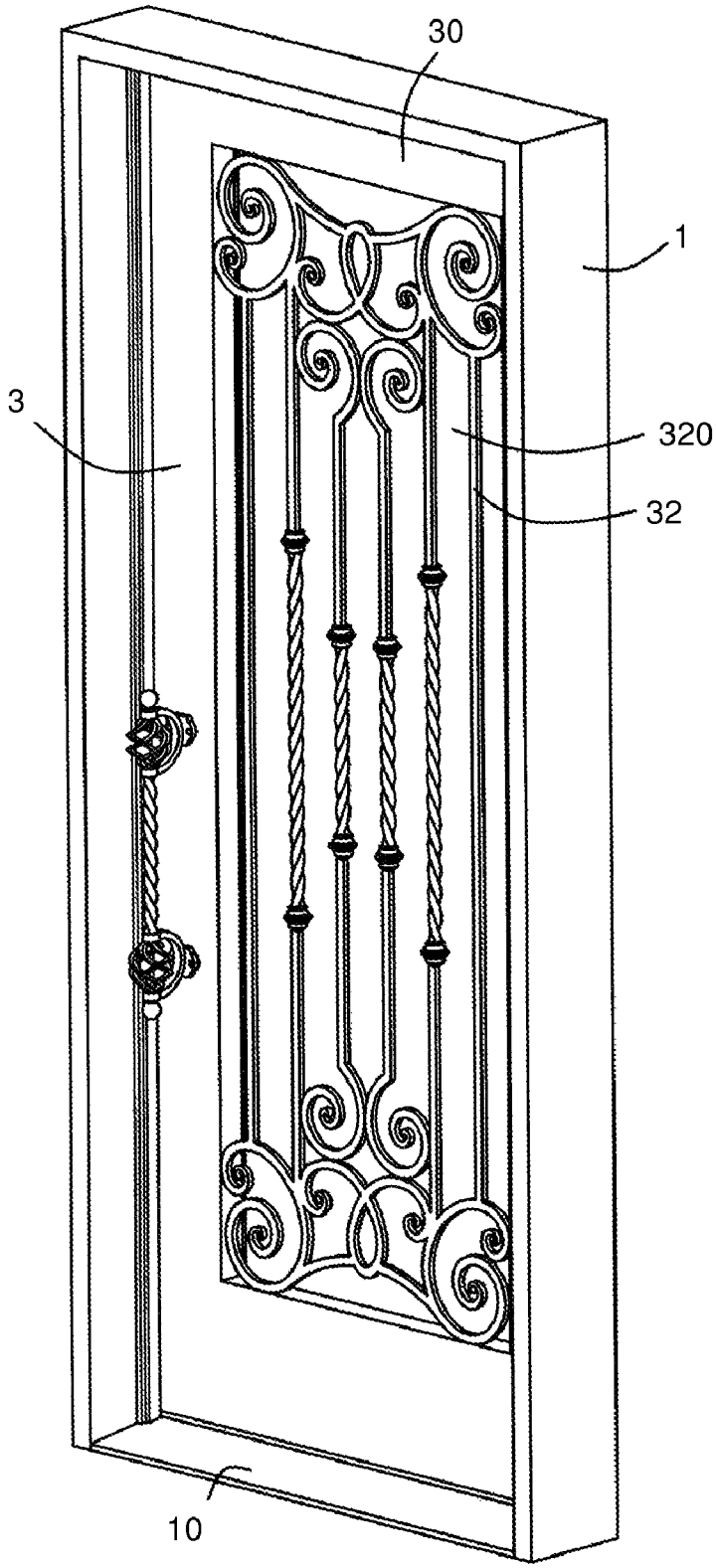
FIG. 2 is a perspective view of the first embodiment of the present invention.
Figure 3:
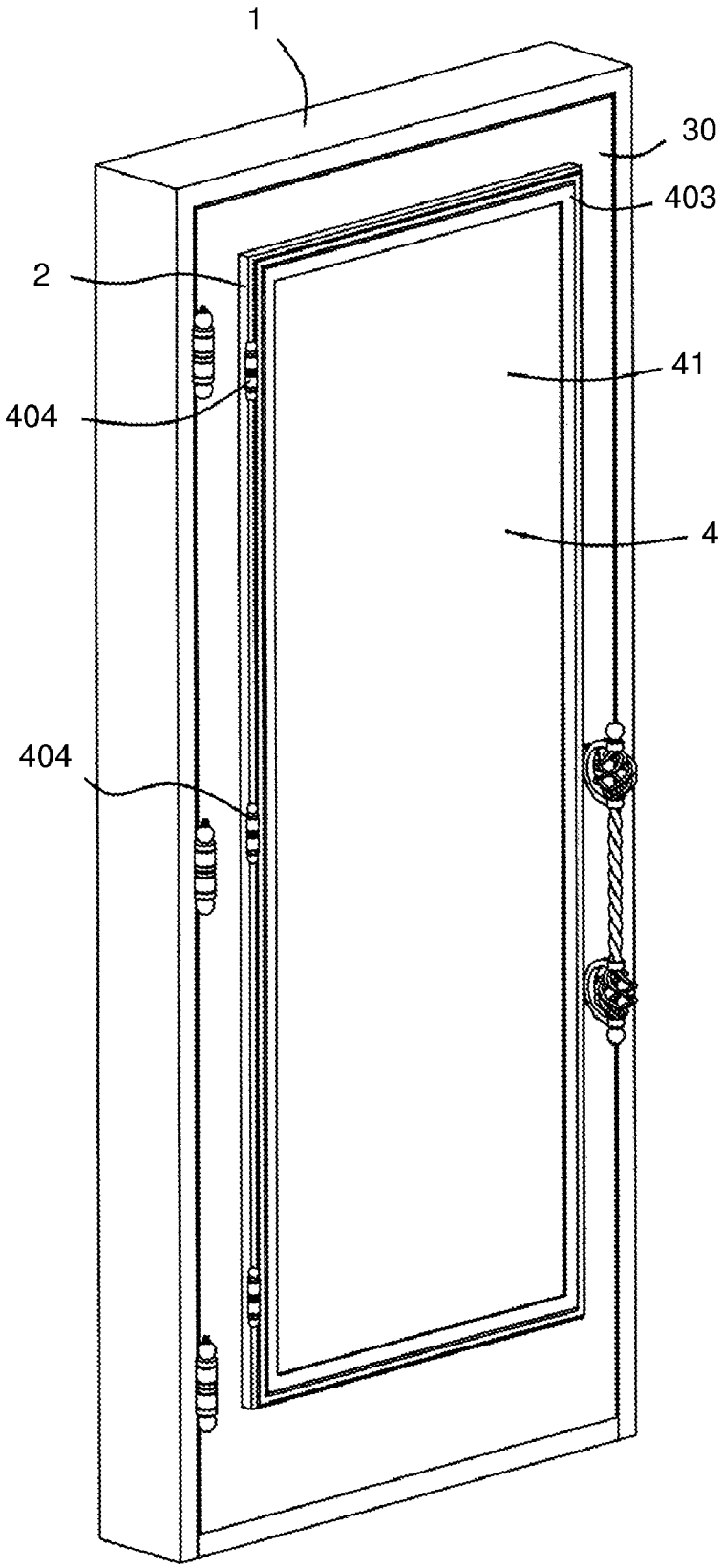
FIG. 3 is a perspective view of the first embodiment of the present invention from another angle.
Figure 4:
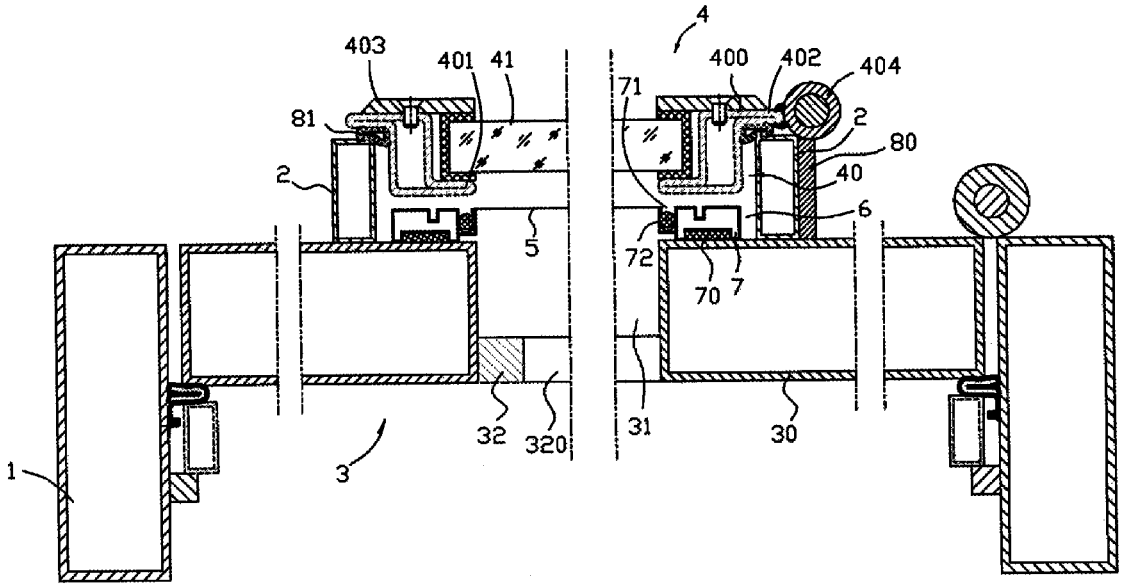
FIG. 4 is a transverse cross-sectional view of the first embodiment of the present invention.
Figure 5:
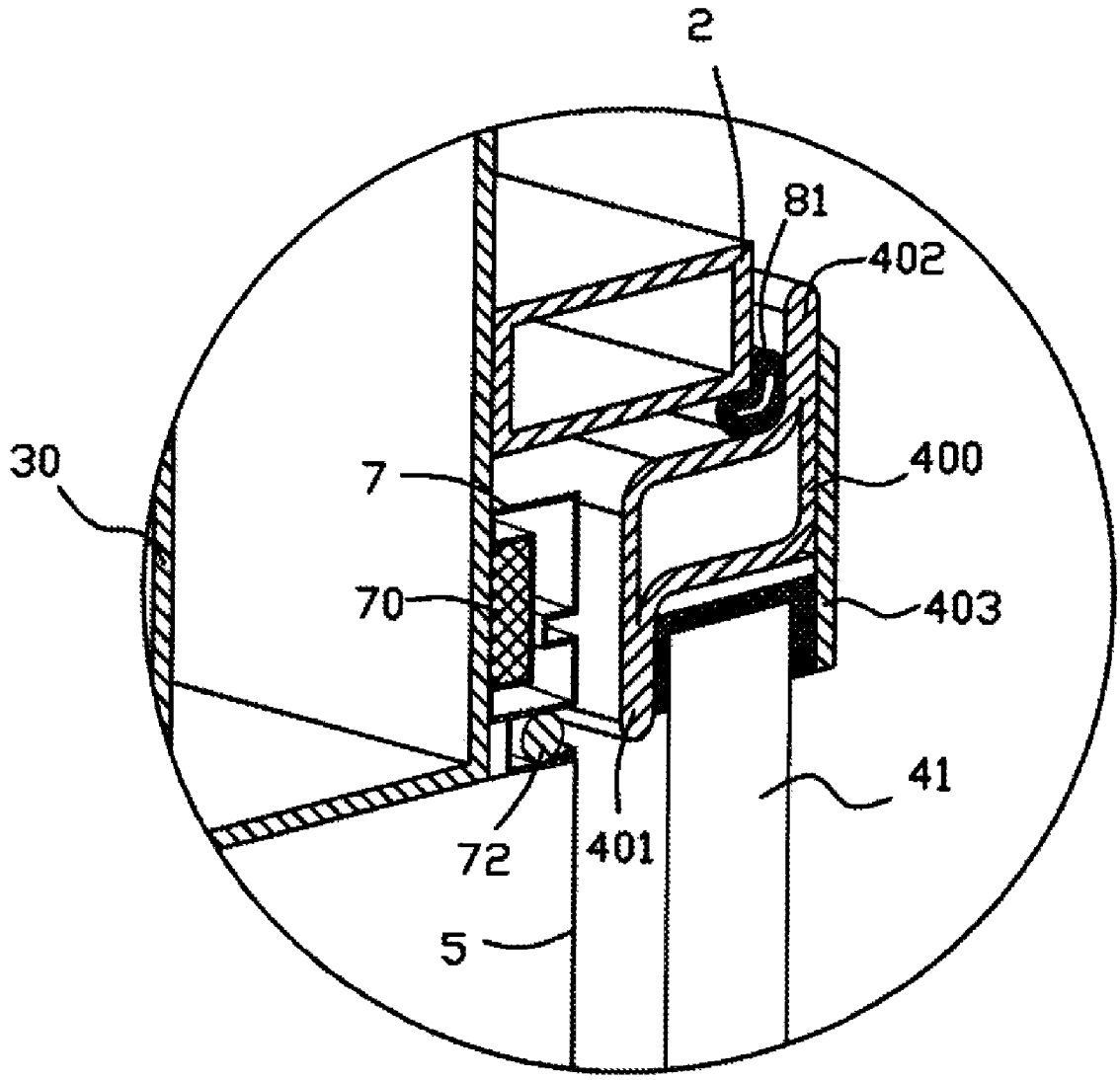
FIG. 5 is an upper portion of a longitudinal cross-sectional view of the first embodiment of the present invention illustrating the rear side face of the door panel frame and the corresponding glass door panel.
Figure 6:
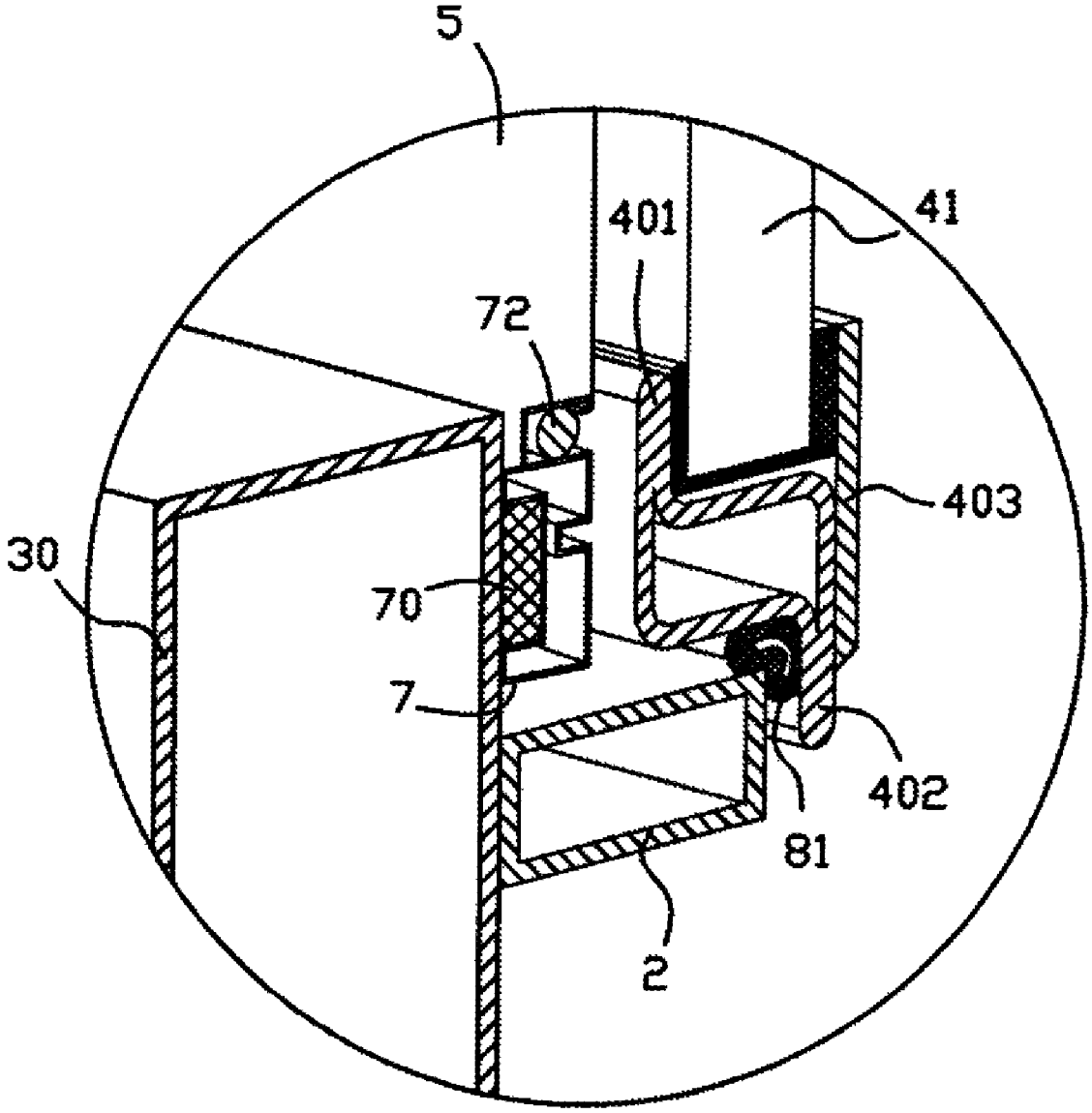
FIG. 6 is a lower portion of a longitudinal cross-sectional view of the first embodiment of the present invention illustrating the rear side face of the door panel frame and the corresponding glass door panel.

FIGS. 2 to 6 illustrate a preferred embodiment of the improved structure of a steel door of the present invention. It comprises a steel door frame 1 and a steel door panel 3 which is hinged on one side of the steel door frame 1. A lower side of the steel door frame 1 is further disposed with a threshold 10. The steel door panel 3 comprises a steel door panel frame 30 and a door opening 31 defined by the door panel frame. The door opening 31 has an interior portion which is disposed with a plurality of steel guarding members 32 forming graphics; portions other than the guarding members in the door opening form hollowed units 320. A rear side of the door panel frame is disposed with a glass door panel 4 which corresponds with the door opening. The glass door panel 4 comprises a steel-made glass door panel frame 40 which surrounds a peripheral body of the door opening and is formed on the rear side of the door panel frame, and a glass 41 which is embedded in the glass door panel frame. One side of the glass door panel frame is hinged on one side of the door panel frame. The glass door panel frame is completely hidden behind the rear side of the door panel frame. The said structure enables the entire content of the graphics formed by the plurality of members viewable from either the front side or the rear side of the steel door, thereby bringing about better visual effect on the graphical presentation and enhancing the artistic and ornamental quality of the steel door.

An anti-mosquito net 5 which covers the door opening 31 is disposed between a front side face of the glass door panel frame 40 and a rear side face of the door panel frame 30 corresponding thereto. A frame-shaped accommodating space 6 is formed between a peripheral body of the front side face of the glass door frame 40 and a peripheral body of the rear side face of the door panel frame 30. A periphery of the anti-mosquito net 5 is secured in the accommodating space 6. After the glass door is opened for ventilation, the said structure can prevent mosquitoes, pests or other things from flying into a house from outside. As a result, ventilation inside the house is guaranteed and mosquitoes and pests are prevented from getting into the house, thereby enhancing the utility of the steel door.

An anti-mosquito net frame 7 for securing the anti-mosquito net is disposed in the accommodating space 6. The anti-mosquito net frame 7 is completely hidden in the accommodating space. A peripheral body of a front side face of anti-mosquito net frame is secured with a magnetic strip 70 which is capable of being attracted with the rear side face of the door panel frame corresponding thereto. The inner peripheral body of the anti-mosquito net frame 7 forms a groove 71 with an opening facing rearward, certainly, the orientation of an opening can also be facing frontward. The periphery of the anti-mosquito net 5 is placed in the groove 71, and is tightly pressed and secured by a rubber strip 72 disposed in the groove 71. The main object of the anti-mosquito net frame 7 is to better secure the anti-mosquito net. Certainly, it is possible to eliminate the anti-mosquito net frame 7 and to have the magnetic strip 70 directly secured on the periphery of the anti-mosquito net 5 to be attracted with the rear side face of the door panel frame.

A rearward protruding securing frame 2 which surrounds the peripheral body of the door opening is disposed on the rear side of the door panel frame. The transverse cross-section of the securing frame is of a hollow rectangular shape. The glass door panel frame 40 comprises a hollow body 400 of rectangular cross-sectional configuration disposed on an inner side of the securing frame. A first flat straight portion 401 extends inwardly from a front end of the body. A second flat straight portion 402 extends outwardly from a rear end of the body. A pressing strip 403 which corresponds to the first flat straight portion is secured on the body. The periphery of the glass 41 is secured between the first flat straight portion and the pressing strip 403. A periphery of the second flat straight portion 402 partially covers the rear side face of the securing frame. The second flat straight portion 402 is disposed with hinges 404 for being hinged on the securing frame 2.

A reinforcement panel 80 is disposed at a hinged area between the second flat straight portion 402 and the securing frame. The main function of the reinforcement panel is to reinforce the strength of the hinged area.

A rubber sealing strip 81 is disposed between the hollow body 400 and the securing frame for a better sealing effect after the glass door panel is closed.

As for the front and rear orientations described in the present invention, "front" refers to the direction from the glass door panel towards the members 32, otherwise is referred to as the "rear". The "inner", "inward", "outer", and "outward" orientations described in the present invention are defined based on the center of the door opening; the direction towards the center of the door opening is referred to as "inner" or "inward", otherwise is referred to as "outer" or "outward". Furthermore, as not to create confusion, FIG. 3 does not show the portions viewable through the glass 41. During installation, one side of the glass door panel is installed on the indoor side.

Figure 7:
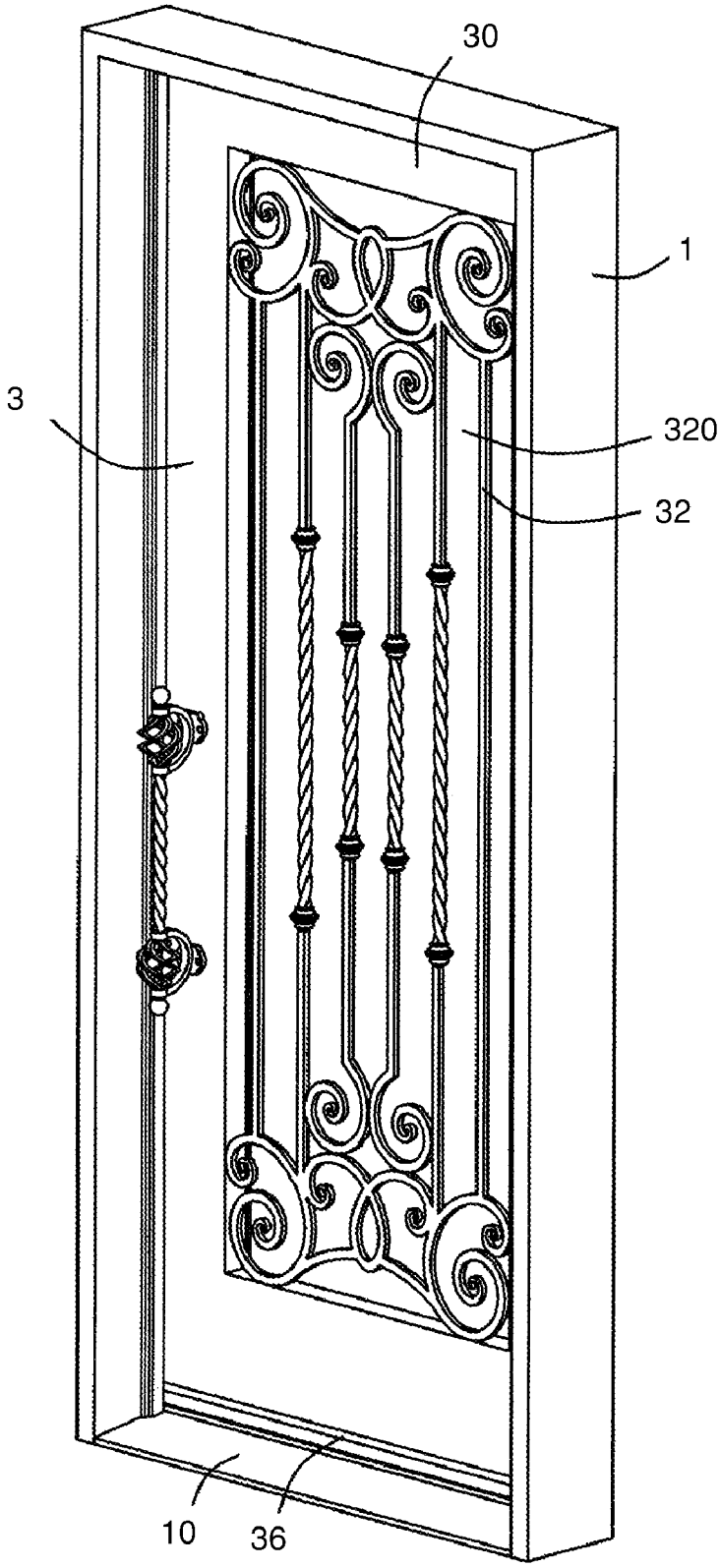
FIG. 7 is a perspective view of another embodiment of the present invention.
Figure 8:
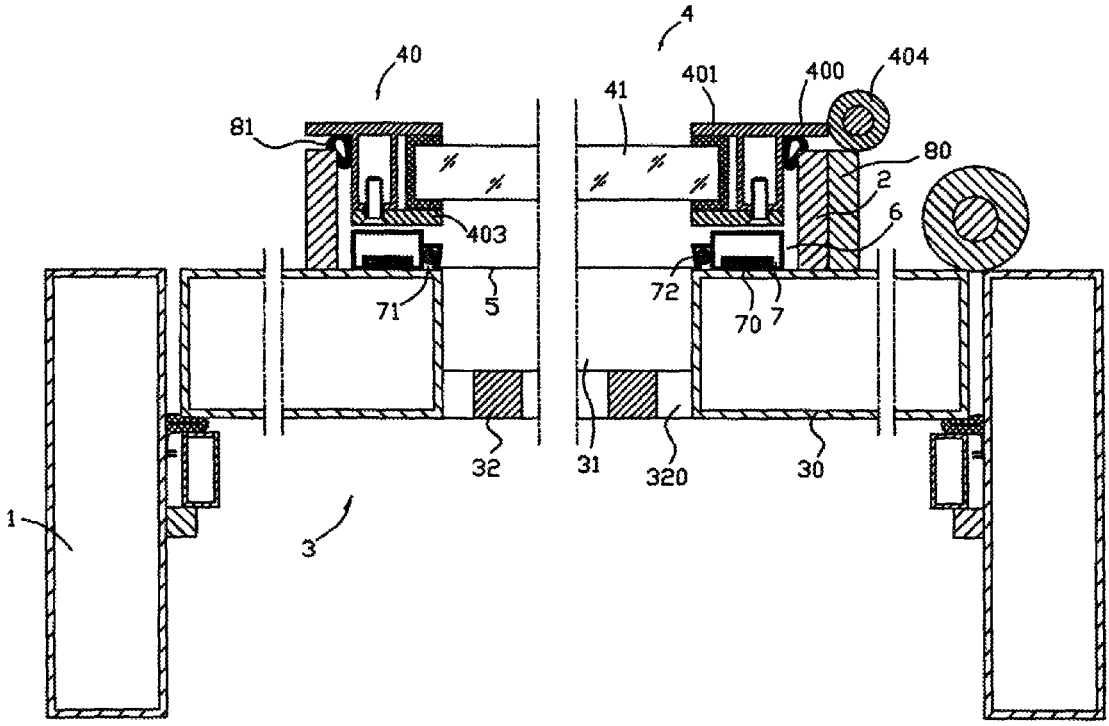
FIG. 8 is a transverse cross-sectional view of another embodiment of the present invention.
Figure 9:
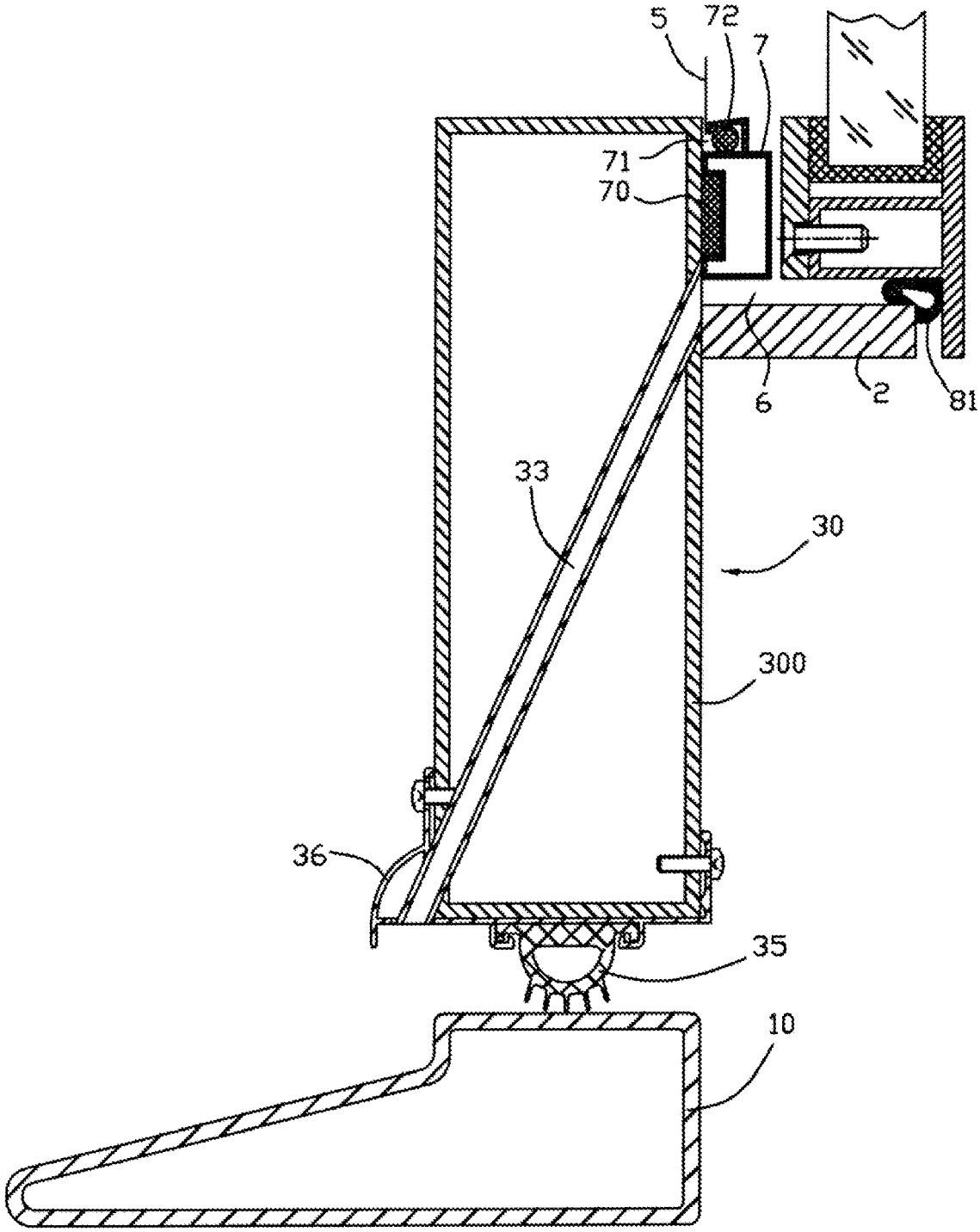
FIG. 9 is a lower portion of a longitudinal cross-sectional view of another embodiment of the present invention illustrating the threshold, the door panel frame and the corresponding glass door panel.

FIGS. 7, 8, and 9 illustrate another embodiment of the present invention. The main difference is that the inner peripheral body of an anti-mosquito net frame 7 forms a groove 71 with an opening facing frontward. A flat straight portion 401 extends inwardly from the rear end of the body. A pressing strip 403 which corresponds to the first straight portion is secured on the body.

Furthermore, a part of the door panel frame 300 corresponding with the threshold is disposed with a drainage channel 33. One end of the drainage channel 33 extends into the accommodating space 6; the other end slopes downwards and extends outward from a front lower side of the part of the door panel frame. The main object of the structure is to drain out the water detained in the lower side of the accommodating space 6.

The front lower side of the part of the door panel frame 300 is disposed with a curved water-proof cover 36. The main object of the structure is to prevent rain from passing through the gap between the bottom face of the part of the door panel frame 300 and the top face of the threshold 10 to get indoor. A rubber wiper 35 which corresponds to a top face of the threshold 10 is disposed on a bottom face of the part of the door panel frame 300. One of the main objects of the structure is to prevent rain from getting indoor from the gap between the bottom face of the part of the door panel frame 300 and the top face of the threshold 10, the other object is to wipe out the water drops on the top face of the threshold 10 when the steel door panel 3 is open.

The above embodiments are merely provided for illustrating the present invention and are should not be considered as limitations of the present invention. Persons skilled in the art can further make various changes and variations, not deviated from the spirit and the scope of the present invention. Therefore, all equivalent technical proposals should fall within the scope of the present invention. The scope of patent protection of the present invention should be defined by respective claims.

What is claimed is:

1. A structure for a steel door comprising a steel door frame (1) and a steel door panel (3) which is hinged on one side of said steel door frame (1), wherein said steel door panel (3) comprises a steel door panel frame (30) and a door opening (31) defined by said door panel frame (30), said door opening (31) having an interior portion disposed with a plurality of steel guarding members (32) forming graphics, with portions other than said guarding members (32) within said door opening (31) forming hollowed units (320); a rear side of said door panel frame (30) disposed with a glass door panel (4) which corresponds with said door opening (31), said glass door panel (4) comprising a steel glass door panel frame (40) surrounding a peripheral body of said door opening and is formed on the rear side of said door panel frame (30) and glass (41) embedded in said glass door panel frame (40), one side of said glass door panel frame being hinged on one side of said door panel frame, said glass door panel frame being completely hidden behind said rear side of said door panel frame when view from the front of said structure; an anti-mosquito net (5) covering said door opening (31) and disposed between a front side face of said glass door panel frame (40) and a rear side face of said door panel frame (30) corresponding thereto; a framed-shaped accommodating space (6) formed between a peripheral body of said front side face of said glass door frame (40) and a peripheral body of said rear side face of said door panel frame (30), a periphery of said anti-mosquito net (5) being secured in said accommodating space (6); an anti-mosquito net frame (7) for securing said anti-mosquito net (5) disposed in said accommodating space (6), said anti-mosquito net frame (7) being completely hidden within said accommodating space (6) when viewed from the front of said structure, a peripheral body of a front side face of said anti-mosquito net frame (7) being secured with a magnetic strip (70) which is capable of being attracted with said rear side face of said door panel frame (30) corresponding thereto, said inner peripheral body of said anti-mosquito net frame (7) forms a groove (71) with an opening facing frontward or rearward, said periphery of said anti-mosquito net (5) being placed within said groove (71) and being tightly secured by a rubber strip (72) disposed in said groove (71).

2. A structure for a steel door as in claim 1, the structure further comprising: a rearward protruding securing frame (2) surrounding said peripheral body of said door opening (31) and disposed on said rear side of said door panel frame (30), said glass door panel frame (40) comprising a hollow body (400) of rectangular cross-section and disposed on an inner side of said securing frame (2), a first flat, straight portion (401) extending inwardly from a front end or a rear end of said hollow body (400), a second flat, straight portion (402) extending outwardly from said rear end of said hollow body (400), a pressing strip (403) which corresponds to said first flat, straight portion and secured on said hollow body (400); a periphery of said glass (41) being secured between said first flat, straight portion and said pressing strip (403), a periphery of said second flat, straight portion (402) partially covering said rear side face of said securing frame (2), said second flat, straight portion (402) being disposed on said securing frame (2) with hinges (404).

3. A structure for a steel door as in claim 2, said structure further comprising: a reinforcement panel (80) disposed at said hinged area between said second, flat straight portion (402) and said securing frame (2).

4. A structure for a steel door as in claim 2, the structure further comprising: a rubber sealing strip (81) disposed between said hollow body (400) and said securing frame (2).

5. A structure for a steel door as in claim 1, the structure further comprising: a lower side of said steel door frame (1) having a threshold (10), wherein a part of said door panel frame (300) corresponds with said threshold (10) and is disposed with a drainage channel (33), wherein one end of said drainage channel (33) extends into said accommodating space (6) and the opposite end slopes downward and extends outward from a front, lower side of said part of said door panel frame (300).

6. A structure for a steel door as in claim 5, the structure further comprising: a rubber wiper (35) corresponding to a top face of said threshold (10) and disposed on a bottom face of said part of said door panel frame (300), said front, lower side of said part of said door panel frame (300) having a curved, water-proof cover (36).

* * * * *